United States Patent [19]

Haygood

[11] Patent Number: 4,616,627

[45] Date of Patent: Oct. 14, 1986

[54] FORCED DRAFT STOVE

[75] Inventor: Lawton C. Haygood, Dallas, Tex.

[73] Assignee: Lawton Haygood Corporation, Dallas, Tex.

[21] Appl. No.: 671,911

[22] Filed: Nov. 16, 1984

[51] Int. Cl.[4] ..... F24C 1/14

[52] U.S. Cl. ..... 126/77; 126/15 A; 126/25 R

[58] Field of Search ..... 126/15 A, 25 R, 25 B, 126/77; 110/157, 300, 298

[56] References Cited

U.S. PATENT DOCUMENTS

| | | | |
|---|---|---|---|
| 3,500,812 | 3/1970 | Korngold | 126/25 |
| 3,529,556 | 9/1970 | Barnes | 110/1 |
| 3,647,323 | 3/1972 | Thomas | 417/234 |
| 3,868,943 | 3/1975 | Hottenroth et al. | 126/25 R |
| 3,933,145 | 1/1976 | Reich | 126/25 R |
| 3,982,522 | 9/1976 | Hottenroth et al. | 126/2 |
| 4,232,653 | 11/1980 | Otterpohl | 126/15 A |

FOREIGN PATENT DOCUMENTS

| | | | |
|---|---|---|---|
| 352999 | 5/1920 | Fed. Rep. of Germany | 126/15 A |

*Primary Examiner*—Carroll B. Dority, Jr.
*Attorney, Agent, or Firm*—Kenneth R. Glaser

[57] ABSTRACT

A forced draft, solid fuel burning stove incorporates a plurality of air distribution conduits disposed intermediate an ash collection receptacle and a solid fuel support grate. The forced draft air is directed upwardly onto a deflector in a manner to permit the flow of air to be evenly distributed across the solid fuel and across the food support surface. The movement of the forced draft air against the deflector establishes a turbulent, randon movement which prevents high concentrations of forced air directly upon the solid fuel, which would otherwise loosen ash particles from the solid fuel and carry them upwardly onto the food support surface. In this manner, the full effect of heat convection through the forced draft medium is evenly distributed across the cooking surface, without the adverse effect of high concentrations of forced draft air directed to certain areas of the solid fuel, which would otherwise result in uneven or rapid burning of the fuel, and consequently uneven cooking of the food upon the food support surface. The flow rate of combustion air delivered by the air distribution conduits is limited and the combustion chamber is sealed against entry of outside air, whereby the combustion rate of the solid fuel is carefully controlled.

4 Claims, 5 Drawing Figures

FORCED DRAFT STOVE

BACKGROUND OF THE INVENTION

1. Field of the Invention

The present invention relates to a forced draft, solid fuel cooking device, and more particularly to a forced draft stove having improved means for evenly distributing the flow of forced draft air through the solid fuel burning area and across the cooking surface.

2. Description of the Prior Art

Prior forced draft cooking devices have utilized forced air flow directed across solid fuel in a manner resulting in areas of high concentration of air flow at different locations on the solid fuel. In some devices, this air flow was directed either from above the solid fuel in a manner to pass somewhat above the fuel and then upwardly to the cooking surface, or was directed upwardly from a point below the solid fuel, which caused movement of solid fuel ashes upwardly onto the cooking surface and onto the food being cooked. Additionally, "hot spot" areas of high heat concentration developed at various locations across the cooking surface which caused overcooking of the food.

It is therefore an object of the present invention to provide a forced draft, solid fuel burning cooking stove which distributes air flow evenly across the entire solid support fuel area in a manner to gain full effect of heat convection through the medium of forced draft air from the solid fuel to the food being cooked.

It is also an object of the present invention to provide a forced draft cooking system in which the combustion rate of solid fuel is controlled and maintained at a low cooking temperature level, thereby conserving the solid fuel and providing a source of moderate heat for cooking tender foods such as fish, poultry and vegetables.

It is a further object of the present invention to provide a forced draft cooking device that produces a uniform heating effect across the food support surface.

SUMMARY OF THE INVENTION

The present invention provides a forced draft, solid fuel burning stove that incorporates a plurality of air distribution openings disposed intermediate an ash collection receptacle and a solid fuel support grate. The forced draft air is directed upwardly onto a deflector in a manner to permit the flow of air to be evenly distributed across the solid fuel and across the food support surface. The movement of the forced draft air against the deflector establishes a turbulent, random movement which prevents high concentrations of forced air directly upon the solid fuel, which would otherwise loosen ash particles from the solid fuel and carry them upwardly to the food being cooked upon the food support surface. In this manner, the full effect of heat convection through the forced draft medium is evenly distributed across the cooking surface, without the adverse effect of high concentrations of forced draft air directed to certain areas of the solid fuel, which would otherwise result in uneven or rapid burning of the fuel, and consequently uneven cooking of the food upon the food support surface.

According to another aspect of the invention the flow rate of combustion air delivered by the air distribution nozzles is limited and the combustion chamber is sealed against entry of outside air, whereby the combustion rate of the solid fuel is carefully controlled.

BRIEF DESCRIPTION OF THE DRAWINGS

Specific features of the invention, as well as additional objects and advantages thereof, will become more readily understood by reference to the following detailed description taken in conjunction with the accompanying drawings, in which like reference numerals refer to corresponding parts, and in which.

DETAILED DESCRIPTION OF THE INVENTION

Figure 1:
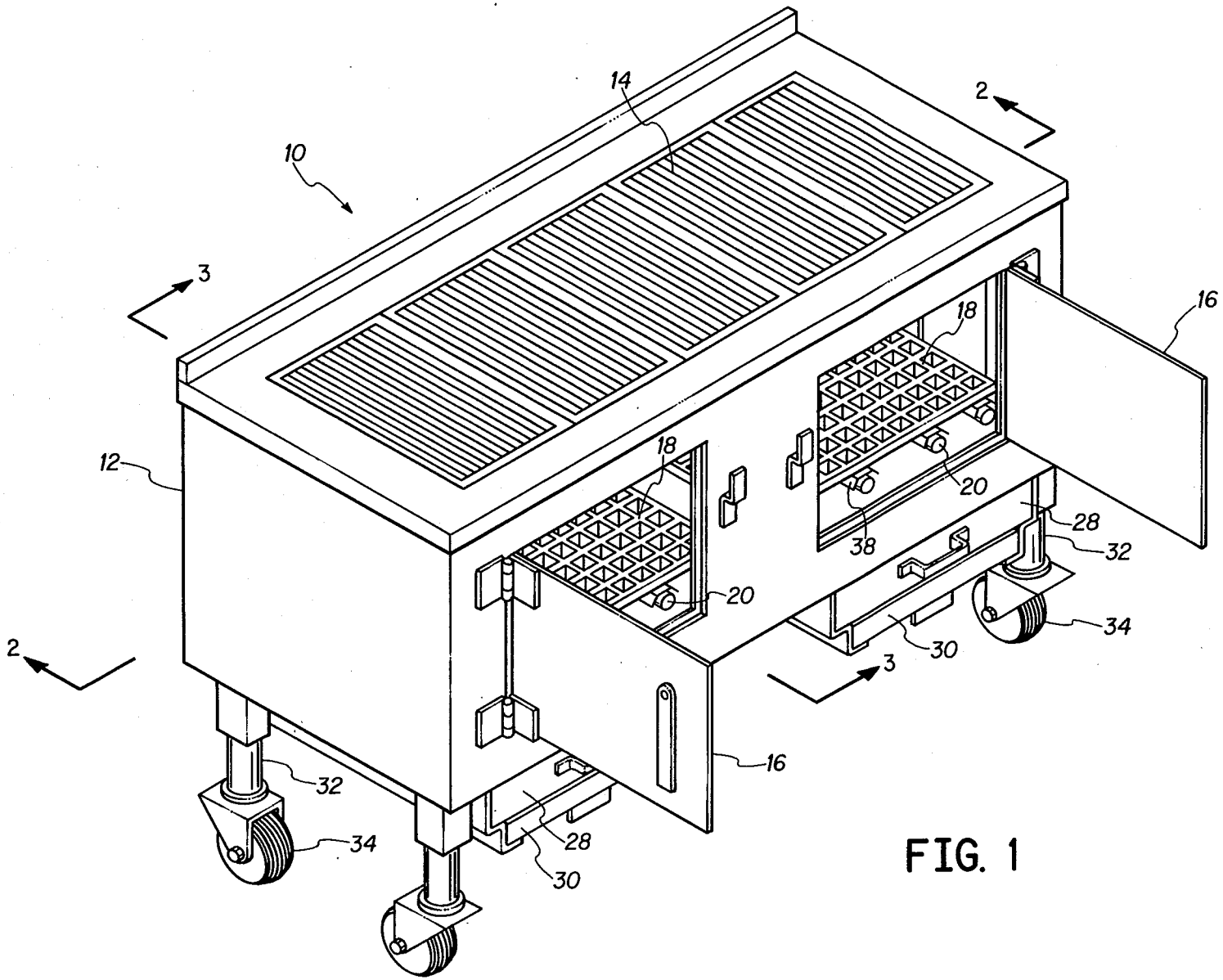
FIG. 1 is a perspective view of the forced draft solid fuel burning stove of the present invention.

Turning now to the drawings, and initially to FIG. 1, the forced draft, solid fuel cooking stove of the present invention is indicated generally by the numeral 10. The cooking unit comprises a housing 12, being rectangular in configuration, and having an upper cooking platform 14 formed in the top side thereof. The cooking platform 14 comprises a rectangular grate adapted to support food to be cooked (meat, fish, fowl, vegetables, etc.) thereupon in the usual manner. The housing 12 is closed on all sides thereof, and is sealed except against entry by outside air except for the grate 14, which permits the flow of forced draft air upwardly therethrough. The housing 12 includes front doors 16 which provide access to a fuel support platform 18 disposed within the combustion chamber 19 below and generally parallel to the cooking grate 14. As in the cooking surface 14, the fuel support platform 18 comprises a grate capable of supporting individual pieces of solid fuel (wood chips, briquettes, logs, etc.) while permitting the flow of forced draft air therearound upwardly from a location below the fuel support platform toward and through the combustion chamber 19 to the food support grate 14. Both the fuel support platform 18 and the food cooking grate 14 are removably positioned relative to the housing 12 in a manner to be easily removed for cleaning purposes, when desired.

As shown in FIG. 1, and more clearly in FIG. 2, a plurality of forced air distribution conduits 20 are disposed within the housing 12 immediately below the fuel support surface 18. These conduits 20 take the form of hollow pipes or tubes that are sealed at the front ends thereof. As best shown in FIG. 3, these conduits 20 are connected in communication with an air supply manifold 22, which in turn, communicates with an air flow blower 24 via an air supply conduit 26. In this embodiment, the air blower 24 takes the form of a cylindrical vane fan coupled to a variable speed electric motor 25.

The injection conduits 20 are disposed in a plane generally below and parallel to the fuel support surface 18. Although only eight air injection conduits 20 are shown, those skilled in the art will appreciate that a different number of conduits may be used to good advantage.

Referring again to FIG. 1, the cooking device 10 includes a pair of first collection trays 28 disposed immediately below the forced air injection conduits 20. In the embodiment shown, a pair of collection trays 28 are utilized; however, any number of trays may be so used, so long as the collection trays are disposed vertically below the solid fuel positioned upon the fuel support system 18. The first collection trays 28 function to collect ashes from the solid fuel, and collect drippings from food placed upon the food cooking surface.

Figure 2:
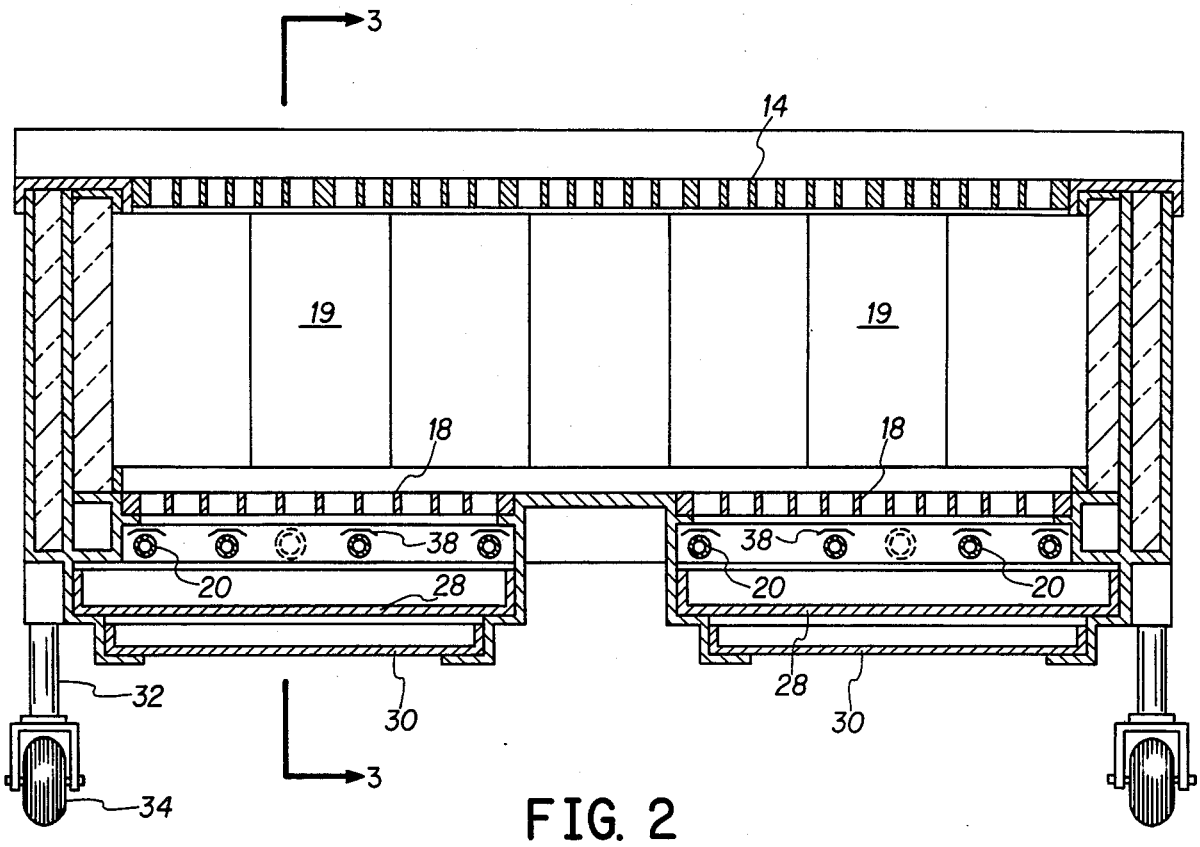
FIG. 2 is a front vertical sectional view of the cooking device taken along lines 2—2 shown in FIG. 1.
Figure 3:
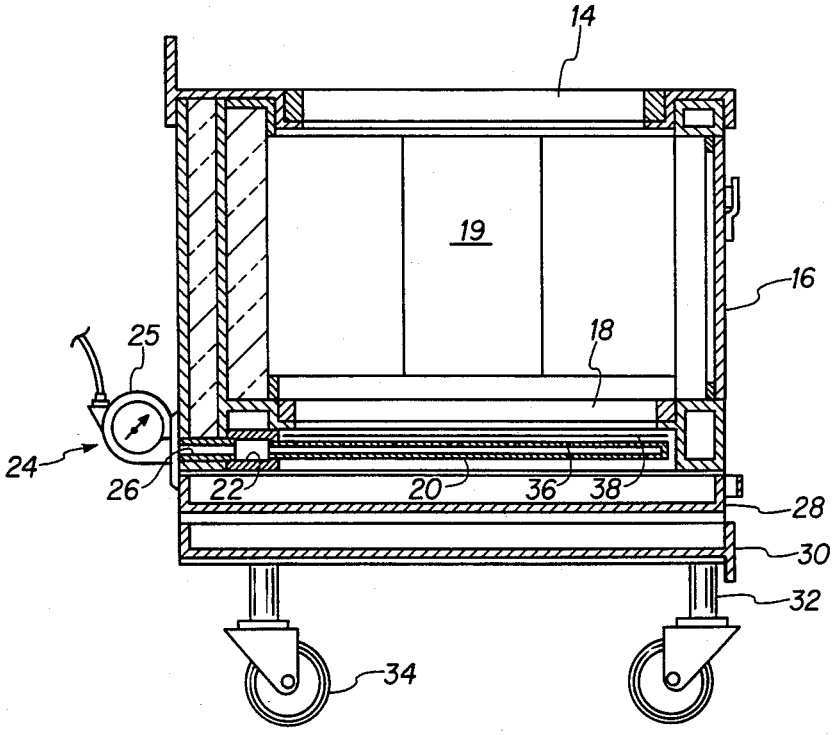
FIG. 3 is a vertical sectional view of the cooking device taken along lines 3—3 shown in FIG. 1.

As best shown in FIGS. 1 and 2, a pair of second collection trays 30 are disposed generally below the first collection trays 28 for collecting ashes and food drippings from the cooking surface 14 and fuel support surface 18, and from the first collection tray 28. In this manner, the first collection trays 18 (the primary collection trays) may be periodically removed for cleaning during the cooking process, whereupon the second collection trays 30 will collect ashes and food drippings and prevent them from staining the floor beneath the cooking device 10.

As shown in the drawings, the housing 12 is supported by four legs 32 having casters 34 thereon, which permit the cooking device to be moved about as necessary. Additionally, the support legs 32 may be adjusted to regulate the elevation of the cooking surface 14 according to personal preference.

Referring again to FIGS. 2 and 3, the forced air injection conduits 20 include a plurality of air nozzles 36 formed on the upper surface thereof in a manner to direct the forced draft air upwardly toward the fuel support grate 18. It will be appreciated that in the forced draft cooking device of the present invention, a sufficient number of air nozzles 36, in combination with regulating the air flow velocity (air flow volume) through the cooking device, will provide a sufficient volume of air flow through the device to effect complete heat convection through the forced air draft medium from the solid fuel upwardly through the combustion chamber 19 to the food disposed upon the cooking surface 14. This is accomplished by varying the speed of the electrical motor 25 to adjust the forced draft air flow rate through the cooking device to limit the combustion rate according to the type and amount of fuel being used, the particular food being cooked, the distance between the solid fuel and the food being cooked.

Figure 4:
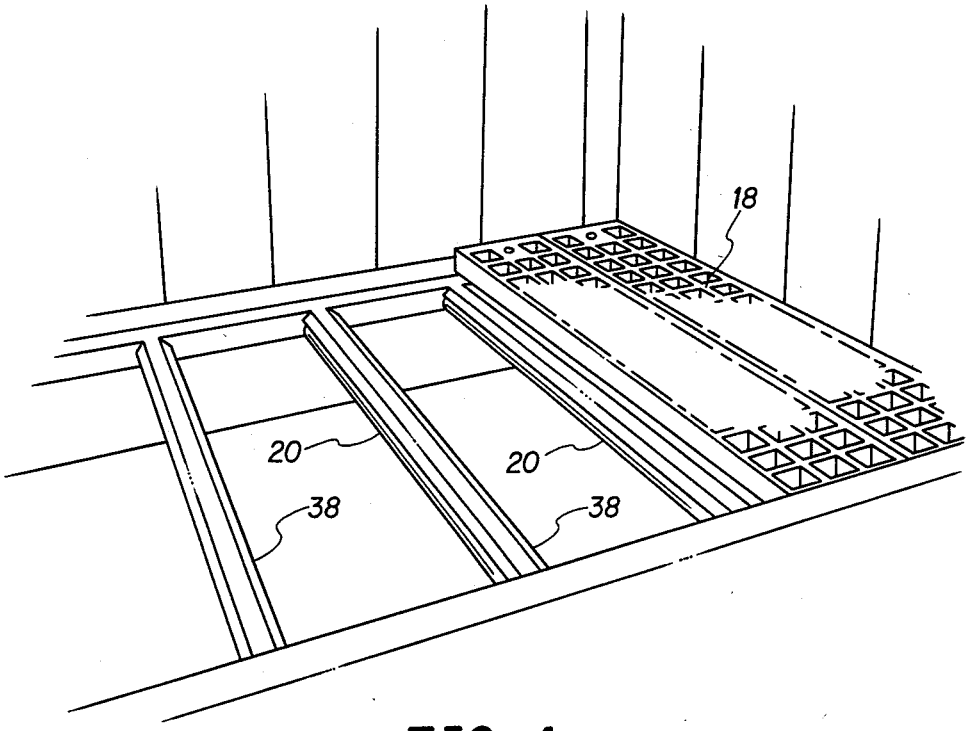
FIG. 4 is a partial perspective view of the interior of the stove shown in FIG. 1; and, FIG. 5 is a sectional view of an air distribution conduit and a deflector.
Figure 5:
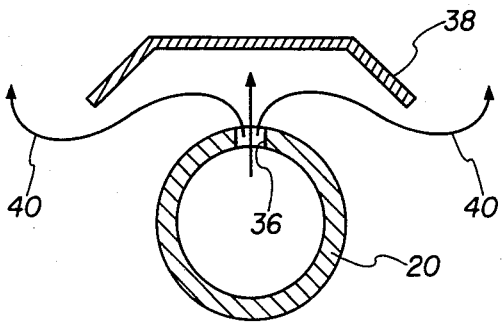

Referring now to FIGS. 4 and 5, turbulent intermixing of forced draft air within the combustion chamber 19 is enhanced by a deflector plate 38 mounted intermediate each air distribution conduit 20 and the fuel support grate 18. Forced draft combustion air 40 is discharged from the distribution tube 20 through the discharge nozzle 36 and onto the deflector 38. The swirling movement of the combustion air 40 as it curls around the deflector plate 38 produces a turbulent, random movement of the forced draft combustion air as it moves upwardly through the fuel support grate 18 and through the combustion chamber 19. The result of the turbulent intermixing of forced draft air is a substantially even distribution of air flow across the fuel support surface and across the cooking surface. Accordingly, concentrations of forced draft air are avoided, and "hot spots" are also avoided.

The flow rate of forced draft combustion air delivered by the blower 24 is limited and the combustion chamber 19 is sealed against entry of outside air, whereby the combustion rate of the solid fuel is carefully controlled. This conserves the solid fuel by permitting it to burn at a carefully controlled rate, without the buildup of high temperatures associated with an uncontrolled draft.

According to another aspect of the invention, the forced draft solid fuel stove of the present invention contemplates the use of a plurality of air supply manifolds 22 and air flow blowers 24, so that the housing 12 may be effectively divided into a plurality of separate, essentially individually controlled forced draft cooking units. It has been determined through experimentation that the forced draft air flow rate through the cooking device may be so controlled within certain specified areas of the cooking device that partitions within the housing are not necessary in order to effect different cooking conditions upon specified areas of the single cooking surface 14.

OPERATION

At the start of the cooking shift, solid fuel pieces (e.g. Mesquite logs) are placed upon the fuel support surface, and ignited in the customary manner. Once the solid fuel pieces are ignited, air flow through the unit is increased in order to provide sufficient oxygen to the fuel to bring the burning fuel up to cooking temperature. When the proper cooking temperature has been achieved at the cooking surface, the air flow through the system is then regulated to provide optimum combustion rate and heat convection through the forced draft air medium from the solid fuel to the food being cooked.

It will be appreciated that during the cooking process, the flow of air through the cooking device is directed initially upwardly from the air injection conduits 20 (specifically through the air nozzles 36) and around the deflector plate 38, as noted by the arrows 40. The rate of air flow through the cooking device of the present invention is regulated such that the forced draft air is distributed essentially evenly across the fuel support surface. The air flow is then directed upwardly through the fuel support surface 18, around the pieces of solid fuel thereon, and essentially upwardly through the combustion chamber 19 to the cooking surface 14 in a manner to cook the food disposed thereon.

During the course of a cooking shift it may be necessary to replenish the supply of solid fuel. The cooking unit of the present invention is especially adapted to permit the solid fuel to be periodically replenished during the cooking process without adversely affecting or otherwise interrupting the cooking process during what would be considered down time in conventional cooking units. When it appears that the solid fuel requires replenishing, the chef simply adds to the existing burning solid fuel disposed upon the fuel support surface 18 as required. In conjunction therewith, it is necessary to temporarily increase the flow of forced draft air through the device in order to rapidly ignite the newly added solid fuel, and to bring the fuel up to cooking temperature. By virtue of the upwardly directed air nozzles 36 which, as explained above, the forced draft air is caused to be evenly distributed across the fuel support surface. In this manner, increased air flow through the combustion chamber is accomplished without the adverse effect of air flow directly upon the solid fuel from the air injection conduits, which would otherwise result in uneven burning of the fuel and ashes being dislodged from the fuel by the effect of the air stream from the nozzles and blown upwardly to collect on the food being cooked.

Although a preferred embodiment of the present invention has been disclosed in detail herein, it will be understood that various substitutions and modifications may be made to the disclosed embodiment described herein without departing from the scope and spirit of the present invention as recited in the appended claims.

What is claimed is:

1. A forced draft solid fuel burning cooking device comprising:

a housing having a combustion chamber bounded by an open upper side and being substantially closed on five sides thereof;

a food support grate covering the upper open side thereof;

a solid fuel support grate disposed within said housing below and parallel to said food support grate;

air injection means disposed within said housing below said fuel support surface for injecting air across solid fuel positioned upon said fuel support grate and into said combustion chamber, said air injection means having an air supply manifold and a plurality of closed end conduits communicating with said air supply manifold, each of said conduits having a plurality of discharge openings directed toward said solid fuel support grate; and, deflector plate means disposed intermediate said air injection means and said fuel support surface for deflecting air as it is discharged by said air injection means.

2. The device as set forth in claim 1, further comprising air flow generation means coupled to said air injection means for generating air flow through said air injection means and into said combustion chamber.

3. The device as set forth in claim 2, wherein said air flow means is adjustable for varying the flow rate of air into said housing.

4. The device as set forth in claim 2, wherein said air flow means comprises an electric motor and blower device.

* * * * *